US007233108B2

(12) United States Patent
Choi et al.

(10) Patent No.: US 7,233,108 B2
(45) Date of Patent: Jun. 19, 2007

(54) PLASMA DISPLAY PANEL

(75) Inventors: Hoon-Young Choi, Suwon-si (KR); Takahisa Mizuta, Suwon-si (KR); Sang-Hoon Yim, Suwon-si (KR); Min Hur, Suwon-si (KR); Young-Do Choi, Suwon-si (KR); Tae-Weon Heo, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 232 days.

(21) Appl. No.: 11/132,348

(22) Filed: May 19, 2005

(65) Prior Publication Data

US 2005/0264232 A1 Dec. 1, 2005

(30) Foreign Application Priority Data

May 31, 2004 (KR) ..... 10-2004-0038930

(51) Int. Cl.
*H01J 17/49* (2006.01)

(52) U.S. Cl. ..... 313/582; 313/584

(58) Field of Classification Search ..... 313/582, 313/584

See application file for complete search history.

(56) References Cited

U.S. PATENT DOCUMENTS 5,825,128 A * 10/1998 Betsui et al. ..... 313/582
6,741,031 B2 * 5/2004 Harada et al. ..... 313/582

* cited by examiner

*Primary Examiner*—Vip Patel
(74) *Attorney, Agent, or Firm*—H.C. Park & Associates, PLC

(57) ABSTRACT

A plasma display panel includes first and second substrates, address electrodes formed on the first substrate, display electrodes formed on the second substrate, barrier ribs formed between the first and second substrates to define discharge cells, each of which acts as a subpixel, and phosphor layers deposited in the discharge cells to form red, green, and blue subpixels. The ends of each subpixel have a first width, and a center area of each subpixel has a center width. The center area of one of the red, green, or blue subpixels is formed having a second width that is smaller than the first width, and the center area of another one of the red, green, or blue subpixels is formed having a third width that is larger than the first width.

12 Claims, 5 Drawing Sheets

PLASMA DISPLAY PANEL

CROSS-REFERENCE TO RELATED APPLICATION

This application claims priority to and the benefit of Korean Patent Application No. 10-2004-0038930 filed on May 31, 2004 in the Korean Intellectual Property Office, which is incorporated herein by reference.

BACKGROUND OF THE INVENTION (a) Field of the Invention

The present invention relates to a plasma display panel (PDP), and more particularly, to a PDP having discharge cells of differing surface areas in order to improve color purity.

(b) Description of the Related Art

A PDP is a display device that displays images by using a plasma discharge to excite phosphors. In particular, vacuum ultraviolet (VUV) rays emitted from plasma, caused by a gas discharge, excite phosphor layers, which then emit visible light that forms an image. The PDP has many advantages, including: an ability to be used in large screen sizes of 60 inches and greater that have a thin profile of 10 cm or less; a wide viewing angle and good color reproduction; and are less costly and easier to manufacture than LCDs. As a result, the PDP is becoming increasingly popular both in the home and industry.

The PDP structure was first developed in the 1970s. The most common configuration in use today is the triode surface discharge structure. The triode surface discharge structure includes a first substrate having two different types of electrodes, one of which is a scan electrode, grouped in pairs that are formed along a first direction, and a second substrate, which is provided at a predetermined gap from the first substrate, having address electrodes that are formed along a second direction, which is substantially perpendicular to the first direction. A discharge gas is sealed in the gap between the first and second substrates. First, an address discharge of the gas is controlled by the scan electrodes on the first substrate, which are independently operated, and by the address electrodes provided on an opposing surface of the second substrate facing the scan electrodes. Next, a sustain discharge, which controls brightness, is provided by the two-electrode groups disposed on the aforementioned first substrate.

An AC PDP having the conventional triode surface discharge structure is shown in FIG. 5. Address electrodes 115 are formed along one direction (i.e., along the y-axis) on a rear substrate 112, and a first dielectric layer 120 covers address electrodes 115. Barrier ribs 117 are formed on the first dielectric layer 120 defining a plurality of discharge cells 119. Barrier ribs 117 may be formed in a stripe pattern along the y-axis as shown in FIG. 5. It is also possible to utilize other configurations such as a matrix pattern, in which case the barrier ribs include barrier rib members extended along both the x and y-axes. Red, green, and blue phosphor layers 118, respectively, are formed in discharge cells 119, which are defined by barrier ribs 117.

Formed on a surface of a front substrate 111 are a plurality of sustain electrodes is 113, 114, which extend in pairs along the x-axis. Each of the sustain electrodes 113 includes a transparent electrode 113*a* and a bus electrode 113*b*, and each of the sustain electrodes 114 includes a transparent electrode 114*a* and a bus electrode 114*b*. Sustain electrodes 113, 114 are covered by a second dielectric layer 121 and then an MgO protection layer 123.

Each area between one of the address electrodes 115 and a pair of the sustain electrodes, and delimited by the intersection of these elements corresponds to a position of one of the discharge cells 119.

Due to the electrical inefficiencies inherent in PDP design, the phosphors used in the PDP must be excitable at an energy level lower than the phosphors used in CRTs. This limits the types of phosphors that may be employed in the PDP. Furthermore, there is a significant difference in illumination efficiency (i.e., brightness) between the different red, green, and blue phosphors used in the PDP. This leads to variances in the efficiency and discharge characteristics between the different phosphor colors, which thereby causes difficulties in adjusting white balance, color temperature, and color purity, for example.

SUMMARY OF THE INVENTION

In accordance with the present invention, a PDP is provided that enhances both discharge efficiency and color purity by modifying the barrier rib structure in accordance with the differing characteristics of the red, green, and blue phosphors.

A PDP includes a first substrate and a second substrate having opposing surfaces that face one another with a predetermined gap therebetween; a plurality of address electrodes formed along a first direction on at least one of the first or second substrates; a plurality of display electrodes formed along a second direction on at least one of the first or second substrates, the second direction being substantially perpendicular to the first direction; a plurality of barrier ribs formed in the gap between the first and second substrates that define a plurality of discharge cells, each of which acts as a subpixel; and a plurality of phosphor layers deposited in the discharge cells to thereby result in the formation of red, green, and blue subpixels, respectively, that are postioned in adjacent triplets such that a pixel is formed by one red subpixel, one green subpixel, and one blue subpixel. Ends of each of the subpixels have a first width that extends along the second direction, and a center area of each of the subpixels has a center width that also extends along the second direction. The center width of at least one of the subpixels comprising the pixel is formed having a second width that is smaller than the first width, and the center width of at least another one of the subpixels comprising the pixel is formed having a third width that is larger than the first width.

DETAILED DESCRIPTION

An embodiment of the present invention will now be described with reference to the drawings.

Figure 1:
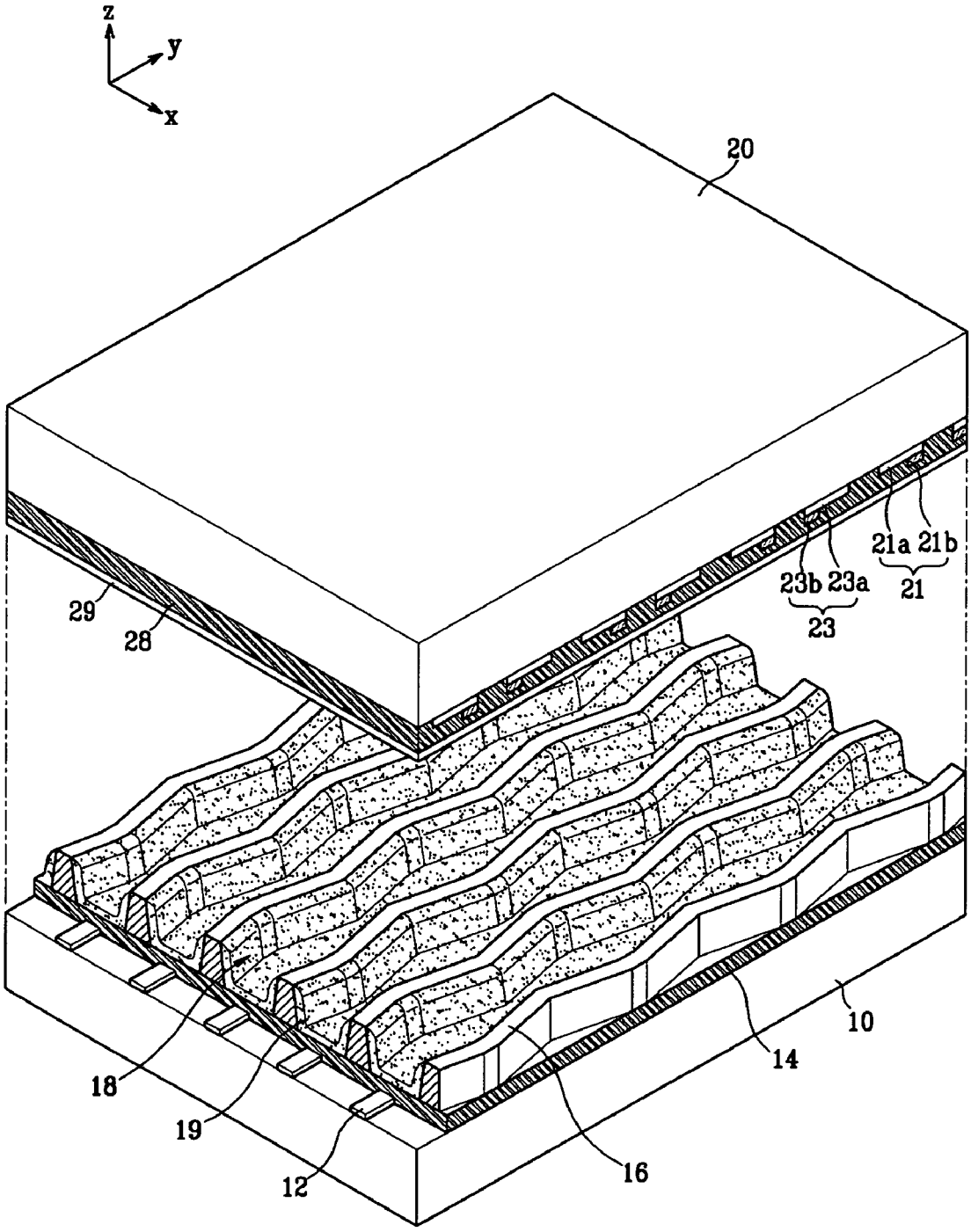
FIG. 1 is a partial exploded perspective view of a PDP according to an embodiment of the present invention.
Figure 2:
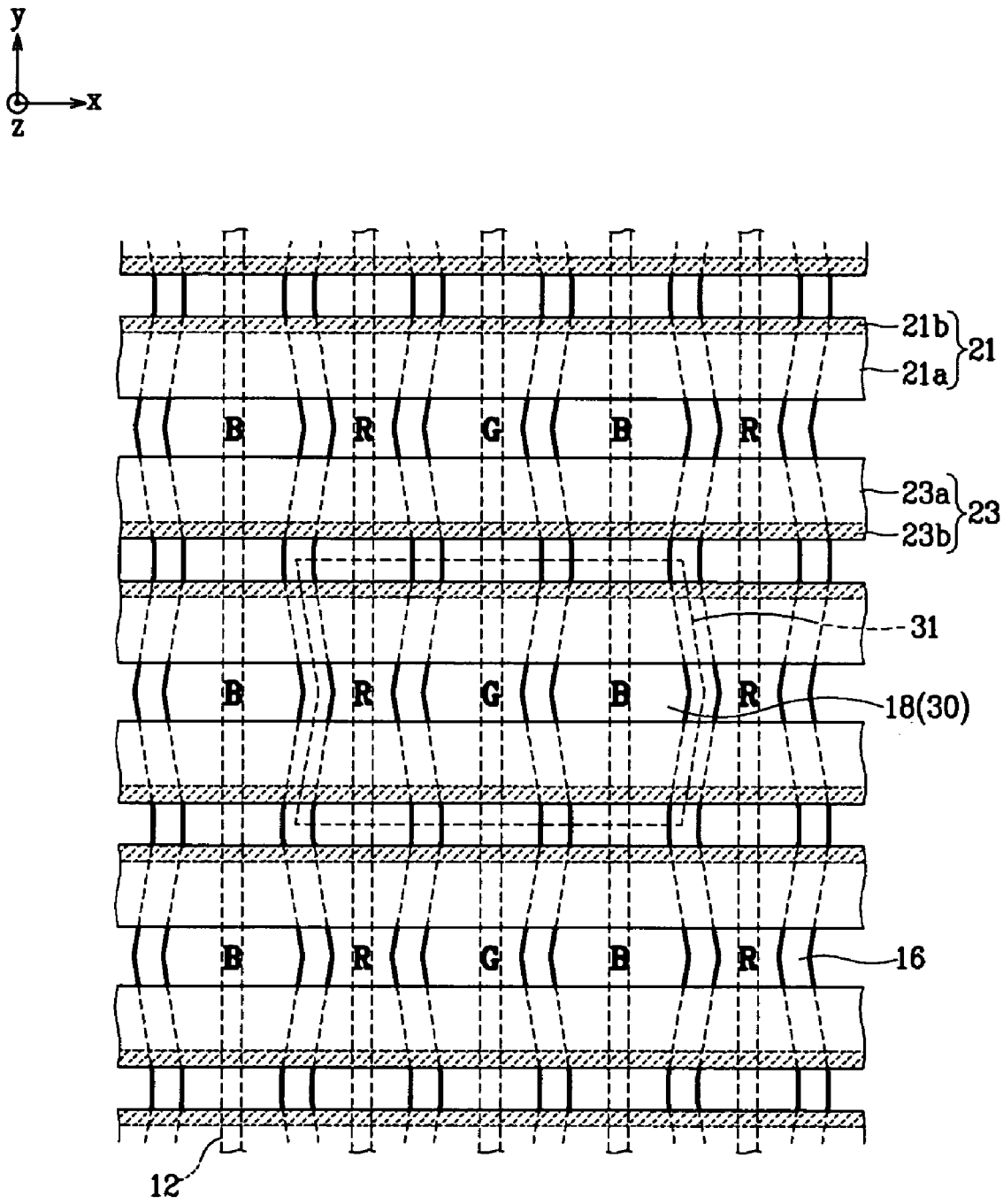
FIG. 2 is a partial plan view of the PDP of FIG. 1.

As shown in FIGS. 1 and 2, a PDP according to an embodiment of the present invention includes a first substrate 10 (hereinafter referred to as a rear substrate) and a second substrate (hereinafter referred to as a front substrate) 20. The rear substrate 10 and the front substrate 20 are provided facing one another with a predetermined gap therebetween. A plurality of barrier ribs 16 are formed in the gap between the substrates 10, 20. The barrier ribs 16 define a plurality of discharge cells 18. The gap between the substrates 10, 20, i.e., discharge cells 18, are filled with a discharge gas (e.g., a compound gas including Xe and Ne) used for plasma discharge.

A plurality of address electrodes 12 are formed on a surface of the rear substrate 10 facing the front substrate 20. Address electrodes 12 extend along a first direction (i.e., along the y-axis), and are covered by a lower dielectric layer 14. A plurality of display electrodes 21, 23 are formed on a surface of the front substrate 20 facing the rear substrate 10. Display electrodes 21, 23 are covered by an upper dielectric layer 28 and protective layer 29, and extend along a second direction (i.e., along the x-axis) that is substantially perpendicular to the first direction Display electrodes 21, 23 cooperate with address electrodes 12 to first select the discharge cells 18 to be illuminated, and then effect a sustain discharge so that the selected discharge cells 18 operate to display an image. Display electrodes 21, 23 may be arranged, for example, assuming that discharge cells 18 are aligned in rows along the x-axis, so that a pair of display electrodes, one being a scan electrode 21 and the other being a sustain electrode 23, is provided for each row of discharge cells 18. Scan electrodes 21 and sustain electrodes 23 are each comprised of a bus electrode 21*b*, 23*b* extending along direction x, and a transparent electrode 21*a*, 23*b* projecting from each bus electrode 21*b*, 23*b*, respectively, substantially along the y-axis towards the opposing transparent electrode. Preferably, transparent electrodes 21*a*, 23*a* are made of a conductive material to ensure a good aperture ratio, and bus electrodes 21*b*, 23*b* are made of a metal material to compensate for the high resistance of the transparent electrodes 21*a*, 23*a* and thereby improve the conductivity of display electrodes 21, 23. It is also possible to form display electrodes 21, 23 using only a metal material, and the present invention is not limited in this respect.

Figure 3:
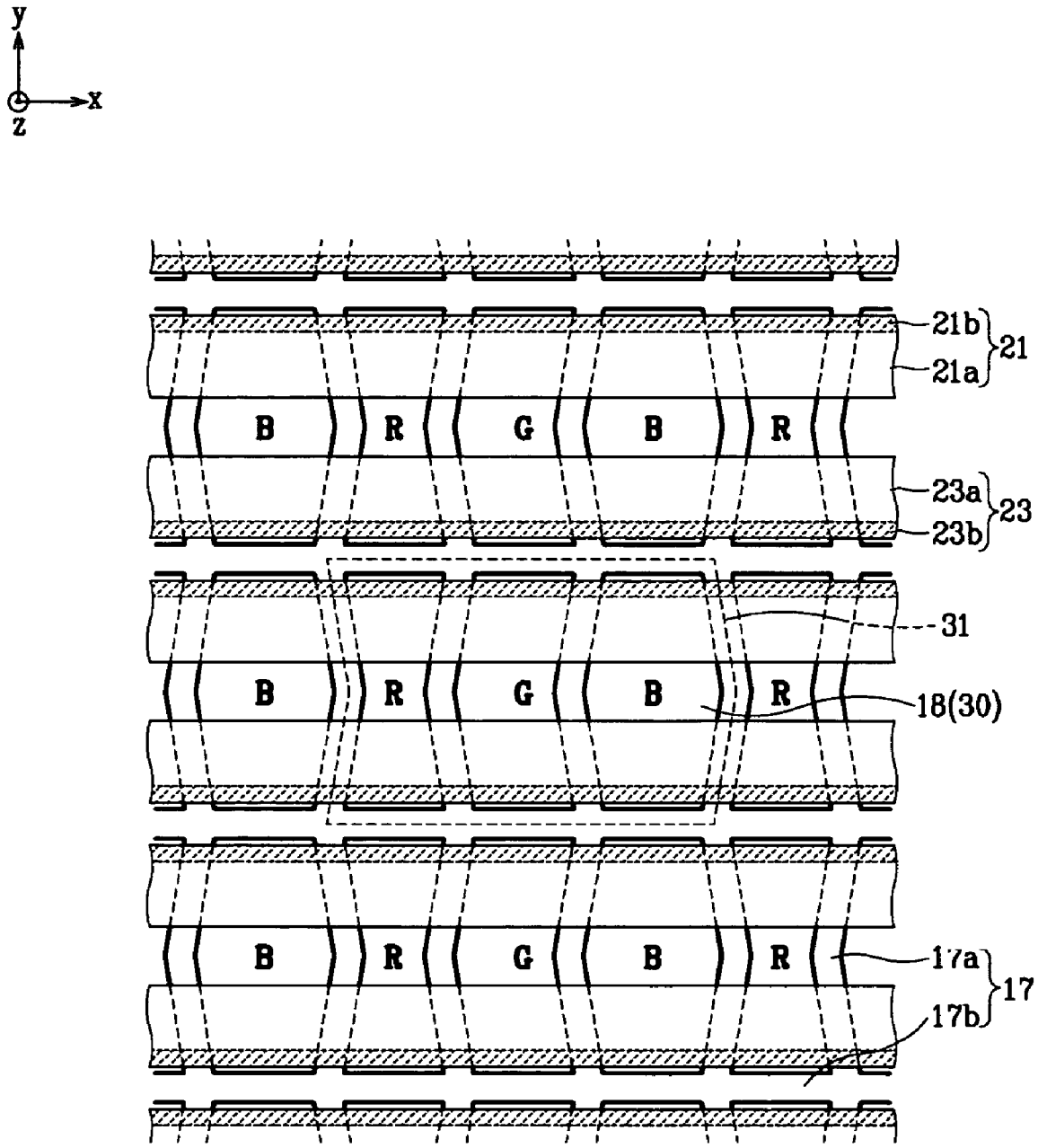
FIG. 3 is a partial plan view illustrating a modified example of the PDP of FIG. 1.

Discharge cells 18 are defined by the barrier ribs 16 as described above. That is, a plurality of discharge cells 18 is formed between each adjacent pair of barrier ribs 16 to realize a planar display screen. The sides of barrier ribs and the exposed top surface of lower dielectric layer 14 are covered by a red, green, or blue phosphor layer 19. As shown in FIGS. 2 and 3, for example, the same color phosphor layer 19 covers the exposed area between two adjacent barrier ribs 16 that extends along the y-axis. Each of the discharge cells 18 forms a subpixel 30, and adjacent red (R), green (G), and blue (B) subpixels 30 form a complete pixel 31. In the described embodiment, triplets of adjacent red(R), green (G), and blue (B) subpixels 30 form pixels 31 along the x-axis.

In a modified example of the described embodiment shown in FIG. 3, barrier ribs 17 include first barrier rib members 17*a* that extend along the y-axis, and second barrier rib members 17*b* that extend along the x-axis to intersect the first barrier rib members 17*a*. Accordingly, the discharge cells 18 are arranged in a closed, or matrix, configuration.

Figure 4:
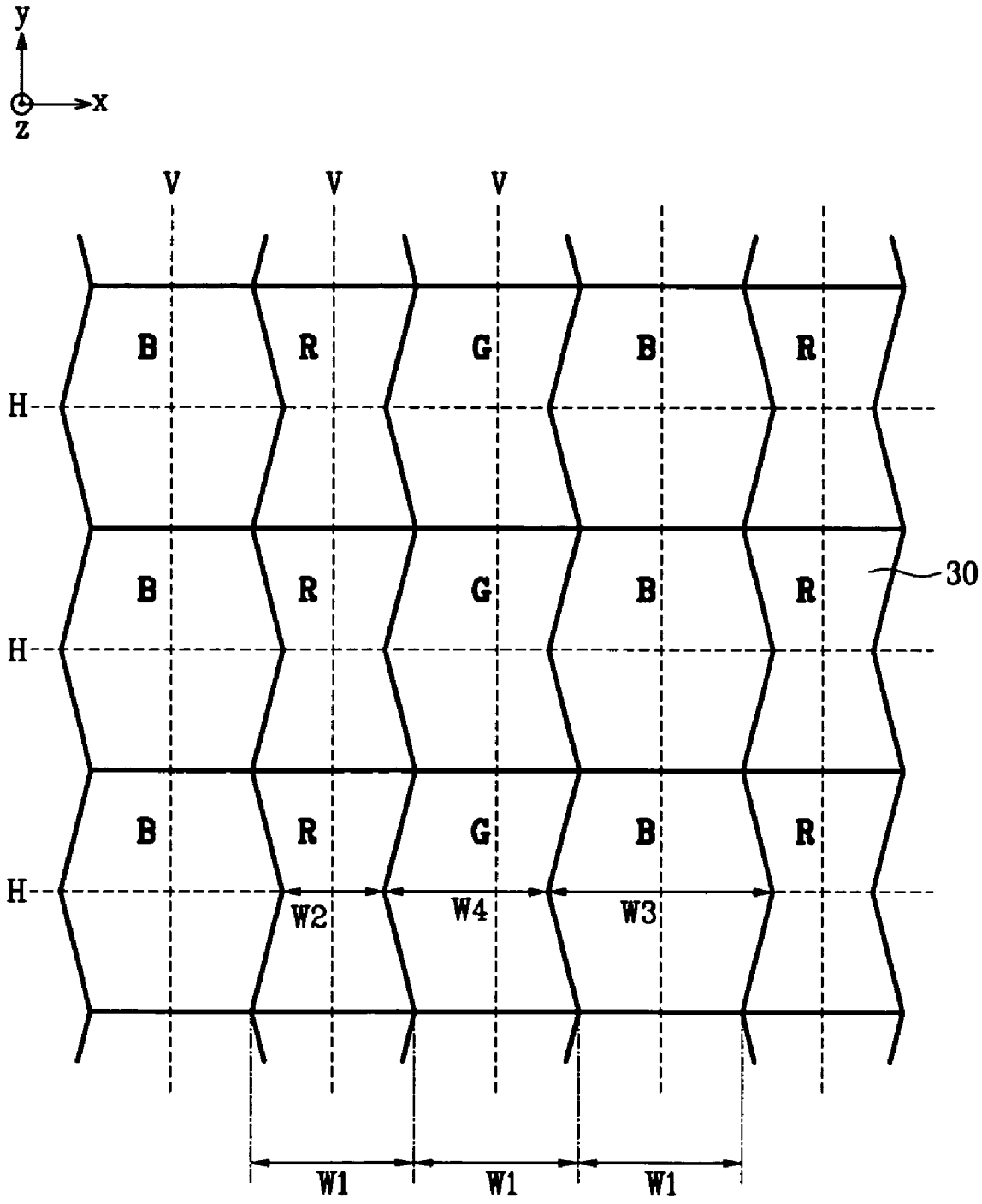
FIG. 4 is a schematic plan view illustrating a barrier rib structure according to an embodiment of the present invention.
Figure 5:
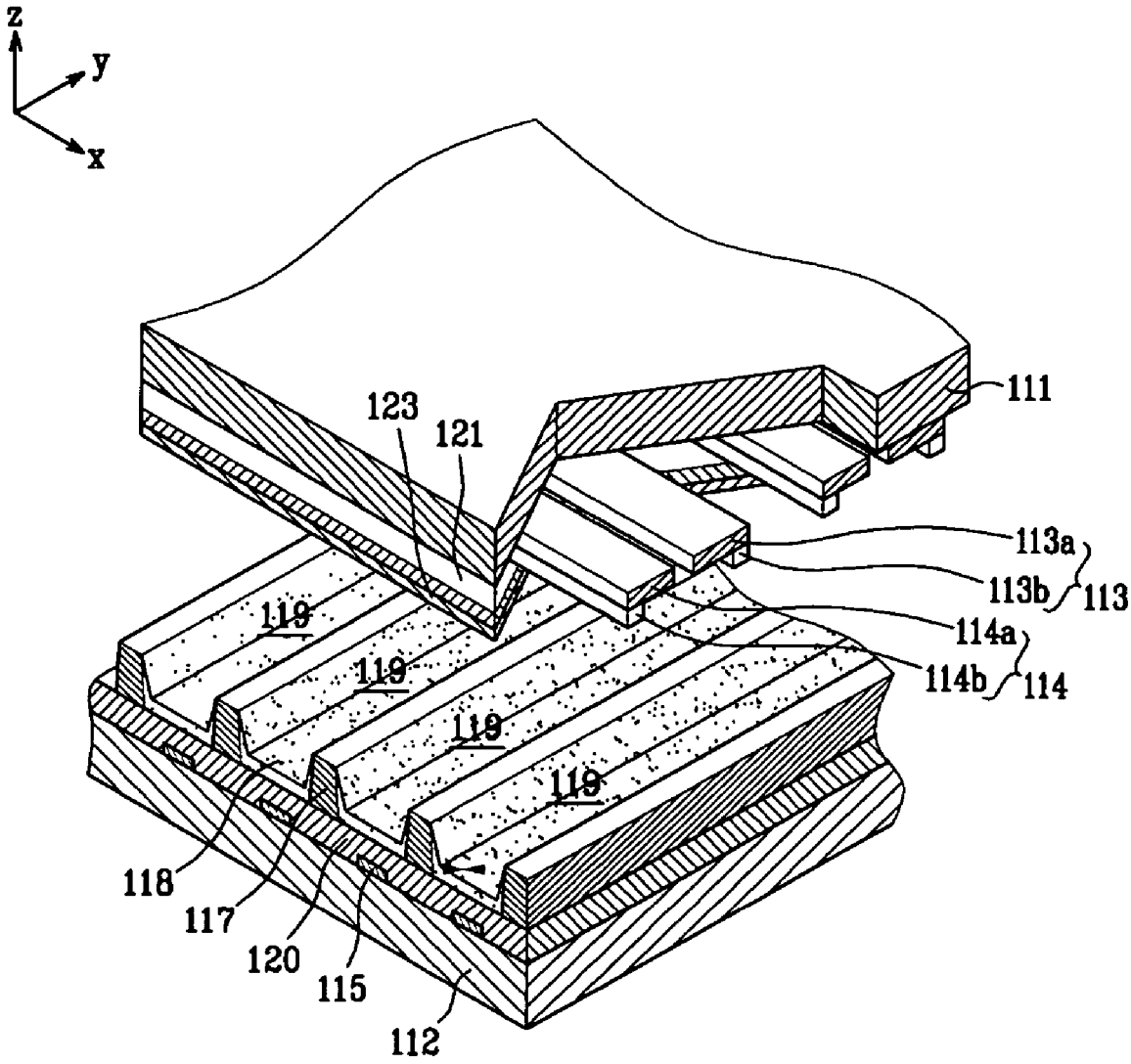
FIG. 5 is partial exploded perspective view of a conventional PDP.

Looking at FIG. 4, each of subpixels 30 has two ends with a substantially identical first width (w1). Further, red subpixels (R) have a second width (w2) at their center, which is smaller than the first width (w1). Blue subpixels (B) have a third width (w3) at their center, which is larger than the first width (w1). Finally, green subpixels (G) have a fourth width (w4) at their center, which is approximately the same as the first width (w1).

For reference, horizontal (H) and vertical (V) reference lines are provided in FIG. 4 that extend along the x and y-axes, respectively, that pass through center points of the ends of the subpixels 30. Red and blue subpixels are symmetrical about both the horizontal and vertical reference lines. Thus, red and blue subpixels have symmetrical upper and lower halves, and symmetrical left and right halves.

In addition, red subpixels are formed with a gradually decreasing width starting from the ends having the first width (w1), and extending to the center area having the second width (w2). Blue subpixels are formed in an opposite configuration. That is, blue subpixels are formed with a gradually increasing width starting from the ends having the first width (w1), and extending to the center area having the third width (w3).

The fourth width (w4) of green subpixels is larger than the second width (w2) of red subpixels and smaller than the third width (w3) of blue subpixels. As described above, the fourth width (w4) is substantially the same as the first width (w1). In the described embodiment, green subpixels are respectively positioned between one of the red subpixels and one of the blue subpixels. In addition, green subpixels are formed symmetrical about the horizontal reference lines (H), but not about the vertical reference lines (V). Upper and lower halves of green subpixels are respectively formed substantially as parallelograms, resulting from the formation of red and green subpixels as described above.

According to the above-described formation of the subpixels 30, their surface areas vary depending on the color of the phosphors deposited therein. Stated differently, phosphor deposition areas of subpixels 30 vary according to the color of the phosphors to be deposited therein. Subpixels 30 are formed (i.e., sized) such that differences in illumination efficiencies between the different phosphor colors are minimized. This results in improvements in color purity, white balance, and color temperature, for example. Further, the deposition area of discharge cells 18 is increased by the formation of subpixels 30 having at least one barrier rib surface that changes in angle. Illumination efficiency is further enhanced by this increase in the deposition area for the phosphors.

With the varying formation of the red, green, and blue subpixels as described above, differing firing voltage and sustain voltage characteristics may result. In this case, the areas and shapes of display electrodes 21, 23 may be altered to compensate for such changes.

In the embodiment of the present invention described above, red subpixels were described as having the second width (w2), blue subpixels as having the third width (w3), and green subpixels having the fourth width (w4). However, this may be varied as needed and according to the phosphor characteristics. In other words, the third width (w3) may be applied to subpixels requiring a relatively large illumination area (i.e., subpixels deposited with a phosphor color with a relatively low illumination efficiency), and the second width (w2) may be applied to subpixels requiring a relatively small illumination area (i.e., subpixels deposited with a phosphor color with a relatively high illumination efficiency). If needed, the ends of the subpixels 30 may be formed to different widths.

Although embodiments of the present invention have been described in detail hereinabove, it should be clearly understood that many variations and/or modifications of the basic inventive concepts taught herein, which may appear obvious to those skilled in the present art will, still fall within the spirit and scope of the present invention, as defined in the appended claims.

What is claimed is:

1. A plasma display panel, comprising:

a first substrate;

a second substrate having a surface facing a corresponding opposing surface of the first substrate, wherein a predetermined gap is formed between the respective opposing surfaces of the first substrate and the second substrate that face one another;

a plurality of address electrodes formed along a first direction on at least one of the first substrate or the second substrate;

a plurality of display electrodes formed along a second direction on at least one of the first substrate or the second substrate, the second direction being substantially perpendicular to the first direction;

a plurality of barrier ribs formed in the gap between the first substrate and the second substrate that define a plurality of discharge cells, each of which acts as a subpixel; and a plurality of phosphor layers deposited in the discharge cells to thereby result in the formation of red, green, and blue subpixels that are positioned in adjacent triplets, wherein a pixel is formed by one red subpixel, one green subpixel, and one blue subpixel, wherein ends of each of the subpixels have a first width extending along the second direction, and a center area of each of the subpixels has a center width also extending along the second direction, and wherein the center width of at least one of the subpixels comprising the pixel is formed having a second width that is smaller than the first width, and the center width of at least another one of the subpixels comprising the pixel is formed having a third width that is larger than the first width.

2. The plasma display panel of claim 1, wherein the center width of yet another one of the subpixels comprising the pixel is formed having a fourth width that is larger than the second width and smaller than the third width.

3. The plasma display panel of claim 2, wherein the fourth width is substantially identical to the first width.

4. The plasma display panel of claim 1, wherein the subpixels having the second width are substantially symmetrical about the second width.

5. The plasma display panel of claim 1, wherein the subpixels having the third width are substantially symmetrical about the third width.

6. The plasma display panel of claim 2, wherein each of the pixels is formed by adjacent subpixels in the order of one subpixel having the second width, one subpixel having the fourth width, and one subpixel having the third width.

7. The plasma display panel of claim 6, wherein a red phosphor layer is deposited in subpixels having the second width, a green phosphor layer is deposited in subpixels having the fourth width, and a blue phosphor layer is deposited in subpixels having the third width.

8. The plasma display panel of claim 1, wherein each of the subpixels having the second width is formed with a gradually decreasing width starting from the ends having the first width, and extending to the center area having the second width.

9. The plasma display panel of claim 1, wherein each of the subpixels having the third width is formed with a gradually increasing width starting from the ends having the first width, and extending to the center area having the third width.

10. The plasma display panel of claim 1, wherein a red phosphor layer is deposited in subpixels having the second width.

11. The plasma display panel of claim 1, wherein a blue phosphor layer is deposited in subpixels having the third width.

12. The plasma display panel of claim 1, wherein the barrier ribs include first barrier rib members extending along the first direction, and second barrier rib members extending along the second direction to intersect the first barrier rib members.

* * * * *